US009308435B1

(12) United States Patent
Rohrmeister

(10) Patent No.: US 9,308,435 B1
(45) Date of Patent: Apr. 12, 2016

(54) STYLIZED BILLIARD RACK AND A METHOD OF PLAYING A MOVING BILLIARD GAME USING THE STYLIZED BILLARD RACK

(71) Applicant: Thomas Rohrmeister, Klagenfurt am Wörthersee (AT)

(72) Inventor: Thomas Rohrmeister, Klagenfurt am Wörthersee (AT)

( * ) Notice: Subject to any disclaimer, the term of this patent is extended or adjusted under 35 U.S.C. 154(b) by 61 days.

(21) Appl. No.: 14/097,855

(22) Filed: Dec. 5, 2013

Related U.S. Application Data

(63) Continuation of application No. 13/101,488, filed on May 5, 2011, now abandoned.

(60) Provisional application No. 61/332,678, filed on May 7, 2010.

(51) Int. Cl.

| | |
|---|---|
| ***A63D 15/00*** | (2006.01) |
| ***A63D 15/20*** | (2006.01) |
| *A63D 15/10* | (2006.01) |
| *A63D 15/04* | (2006.01) |

(52) U.S. Cl.
CPC ..... *A63D 15/00* (2013.01); *A63D 15/005* (2013.01); *A63D 15/006* (2013.01); *A63D 15/04* (2013.01); *A63D 15/10* (2013.01)

(58) Field of Classification Search
CPC ..... A63D 15/006; A63D 15/10; A63D 15/00; A63D 15/005
USPC ..... 473/26, 40, 41, 42; D21/782
See application file for complete search history.

(56) References Cited

U.S. PATENT DOCUMENTS

| | | | | |
|---|---|---|---|---|
| 3,985,355 | A | | 10/1976 | Shoemaker |
| 4,053,153 | A | * | 10/1977 | Josenhans ..... 473/43 |
| 4,984,788 | A | | 1/1991 | Harriman |
| 5,026,052 | A | | 6/1991 | Shelnutt |
| D326,956 | S | * | 6/1992 | Damianoe et al. ..... D2/960 |
| 5,350,171 | A | | 9/1994 | Wozniak |
| D374,698 | S | * | 10/1996 | Paciorek ..... D21/782 |
| 5,800,273 | A | | 9/1998 | Potocki |
| 5,873,787 | A | * | 2/1999 | Colak ..... 473/2 |
| 6,068,558 | A | | 5/2000 | Gill et al. |
| 6,902,490 | B1 | | 6/2005 | Swearman |
| 7,037,206 | B2 | | 5/2006 | Fliedner et al. |

(Continued)

OTHER PUBLICATIONS

Mike Shamos, "The New Illustrated Encyclopedia of Billiards", copyright ©1993, 1999, 2002, ISBN 1-58574-685-1, (cover 3pgs. + pp. 34-35 + p. 42 + p. 119 + p. 129 + p. 149 + pp. 157-158 + p. 181 + p. 215 + p. 232 + p. 258, 15 pages total).

(Continued)

*Primary Examiner* — Mitra Aryanpour
(74) *Attorney, Agent, or Firm* — Buckley, Maschoff & Talwalkar LLC

(57) ABSTRACT

A moving billiards system for moving billiards game play is described. The moving billiards system includes a pocket billiard table having a rectangular playing surface with two opposing long-side edges and two opposing short-side edges and at least four corner pockets and two side pockets. The moving billiard system also includes a rack having a five-sided frame wall construction configured and sized to provide a stylized double-bolt arrangement of at least eleven object balls, and a movement space surrounding the billiard table. The movement space allows a first team having at least a first player and a second player and a second team having at least a third player and a fourth player to freely move about the billiard table during moving billiards game play.

10 Claims, 5 Drawing Sheets

(56) References Cited

U.S. PATENT DOCUMENTS

| | | | | |
|---|---|---|---|---|
| 7,264,551 | B2 | 9/2007 | Ghahraman | |
| 7,468,002 | B2 | 12/2008 | Robledo et al. | |
| 2002/0111220 | A1 * | 8/2002 | Trimino et al. | 473/42 |
| 2006/0172809 | A1 | 8/2006 | Woods | |
| 2009/0215546 | A1 | 8/2009 | Rogers | |

OTHER PUBLICATIONS

Article, "Speed Pool", Jun. 6, 2008, Billiards Forum Editor, 1pg.

"American CRUD Players Association Official Rules 2000", 1988, 200 Freemans Tracy, Yorktown, VA 23693, 2pgs.

* cited by examiner

STYLIZED BILLIARD RACK AND A METHOD OF PLAYING A MOVING BILLIARD GAME USING THE STYLIZED BILLARD RACK

CROSS REFERENCE TO RELATED APPLICATION

This application is a continuation of co-pending U.S. patent application Ser. No. 13/101,488 filed on May 5, 2011, which claims the benefit of U.S. Provisional Patent Application No. 61/332,678 filed on May 7, 2010, the contents of which are incorporated in their entirety by reference herein.

FIELD OF THE INVENTION

The invention generally relates to a "Moving Billiards" pocket billiard game for two teams of at least two players that may be played on a conventional billiard table using a cue ball, cue sticks and object balls, and that includes rules devised to increase competitiveness, speed of play, and spectator interest.

BACKGROUND

Pocket billiards is played on a generally rectangular table that includes a flat, felt-covered hard playing surface (such as felt-covered slate) that is twice as long as it is wide. A billiards table has a total of six pockets, including one pocket located at each of the four corners of the rectangle, and one pocket located in the center of the two long side boundaries, or rails, or bumpers of the table. Varying numbers of object balls, identical in diameter and small enough to be able to enter each of the pockets smoothly, are used as targets. One white ball, commonly known as the cue ball, which may have a slightly larger diameter than the object balls but still be small enough to enter each pocket smoothly, is struck by a player utilizing a cue stick who aims the cue ball to strike one or more of the object balls. Typically, the goal of a pocket billiard game player is to strike the cue ball so that it rolls towards and contacts one or more of the object balls to result in one or more of the object balls entering the pocket(s). In most pocket billiard games there is a penalty if the cue ball enters one of the pockets.

Various types of pocket billiard or "pool" games are known. An example is a pool game conventionally called "Nine-Ball" that is played with nine object balls, labeled with numbers 1 to 9. To start a Nine-Ball game, the nine object balls are gathered together into a diamond-shaped "rack" at the foot of the pool table. The ball nearest to the center of the table is called the "apex ball", and it is positioned on a "foot" spot typically found on the felt surface of the pool table. The rack is then removed so that a first player can take an opening or "break" shot (by forcefully shooting the cue ball by striking it with the tip of a cue stick) to scatter the object balls widely and to hopefully "sink" or pocket at least one of them. This is known as an "open break" and according to the Nine-Ball rules, at least four object balls must contact some cushion for the shot to be legal. The player who is successful at pocketing a ball on the break shot may continue playing. As play continues, Nine-Ball rules require the shooting player to shoot the cue ball to first contact the lowest-numbered ball remaining on the table. The player who first pockets the Nine-Ball legally is the winner of the "rack", and a Nine-Ball match is won by the first player who wins a predetermined number of racks.

A problem with Nine-Ball is that professional players are so skilled that a substantial chance exists that the player who opens the game will "run out", which means that he or she will pocket a ball on the break shot and then sink all the remaining object balls in numerical order to win the game. The rules specify that the winner of a rack of a Nine-Ball game may break the next rack, so a skilled player could win several games in a row without the opponent taking a single shot. This aspect of Nine-Ball reduces competitiveness, exacts a heavy penalty for failing to pocket a ball, and from a spectator viewpoint can be boring to watch. In addition, a player who fouls by failing to contact the lowest-numbered ball or who "scratches" by pocketing the cue ball not only loses her turn, but is also subjected to a severe penalty called "cue ball in hand". This rule permits the next player (opponent) to place the cue ball anywhere on the table before shooting, which means that a single foul or scratch can easily lead to the loss of that Nine-Ball game.

One of the most popular pocket billiard games in the United States is called "Eight-Ball", and it is played with a standard rack of 15 object balls that are placed in a triangular rack. One group of object balls are numbered 1 through 7 and bear solid colors in addition to numerals. Thus, the balls in this group are known as "solids". Each ball in the group of balls numbered 9 through 15 includes a stripe in addition to a numeral, and therefore these balls are known as "stripes". The "8-Ball" itself is typically solid black in color and has a white circle bearing the number "8". To start a game of Eight-Ball, the balls are racked in the triangle so that the solids and stripes balls alternate and the 8-Ball is in the center and thus surrounded by the object balls. When the rack is removed, the apex ball lies on the foot spot on the billiard table surface and the first player must attempt an opening break. When a player first legally pockets an object ball (during or after the break shot), the "group" or "type" (solids or stripes) to which that ball belongs become that player's group for the remainder of that game. Thus, during play of an Eight-Ball game, the player must shoot the cue ball to first contact a ball of his or her group and then can keep playing as long as a ball of that group is legally pocketed. After all of the balls of a player's group have been pocketed (for example, the player sank all of the "solids") then that player can attempt to pocket the Eight-Ball. The player who first legally pockets the 8-Ball is the winner. According to the rules of Eight-Ball, the break shot for subsequent games alternates between players, regardless of who won the preceding game.

During play of an Eight-Ball game, the balls of a player's group (solids or stripes) do not have to be contacted or pocketed in any particular order, and thus the player at the beginning of a rack has numerous balls that he can shoot at which may allow him or her to run the table. Therefore, Eight-Ball suffers from the same deficiencies as Nine-Ball because a skilled player can easily run the table. Furthermore, like in Nine-Ball, the penalty for a foul in Eight-Ball is cue ball in hand. Thus, competitiveness is reduced, and spectators may also find Eight-Ball boring to watch.

Another pocket billiards game that is popular in the United Kingdom is called "Snooker". It is played on a 12-foot long table having narrow pockets with 21 small object balls consisting of 15 solid red object balls and six other object balls (known in the UK as "colors"), each of a different solid color. At the beginning of the game, the 15 red balls are racked in a triangle, while the colors balls are placed on predefined spots on the table. The general object of Snooker is to alternately pocket a red ball and then a color ball, and then another red ball and another color ball, until no more red balls remain on the table. When that point is reached, the remaining colors balls must be pocketed in a predetermined order. Any colors ball that is pocketed immediately after a red ball is pocketed is returned to the table. A player receives one point for pocketing a red and a greater number of points for pocketing a colors ball. Although the balls themselves do not bear numerals, the colors balls are assigned point values that range from two to seven points. Snooker possesses a complex system of penalties for infractions of the rules. For example, a foul occurs when a player fails to contact a colors ball when required, or when she fails to contact a red ball when required, and the penalty for that is to add from four to seven points to the opponent's score. The "frame" terminates when all balls have been pocketed, and the player with the larger number of points at that time is the winner.

In Snooker, it is not considered an advantage to play a break shot because of the low probability of pocketing a ball. Therefore, a frame of Snooker typically begins with players attempting to position the cue ball in a disadvantaged location for their opponent, rather than trying to pocket a ball. Thus, in contrast to Nine-Ball or Eight-Ball (which can be too rapid), Snooker can be a very slow game. Even if the players never miss a shot, a total of thirty-six balls must be pocketed before the frame ends. (Fifteen reds, each followed by a colors ball, and then followed by the six colors balls in order.) In addition, the narrow pockets of the Snooker table increases the difficulty of pocketing balls, so that a single frame may take more than 30 minutes for professional players to play, and considerably longer for beginners. Moreover, since points are awarded for defensive play (i.e. placing the cue ball in such a position that the opponent cannot hit the required ball), stretches of play may occur in which the players are not even attempting to pocket a ball. Such defensive play lengthens the Snooker game and causes tedium for both the players and the spectators.

Accordingly, a need exists for a pocket billiards game that is more challenging than Nine-Ball and/or Eight Ball (i.e., is more difficult for a player to run out), while at the same time plays faster than Snooker. There is also a need for a team billiards game requiring two or more players on each team that incorporates strategy and tactics in a high-energy manner, wherein the team players must focus and concentrate on all of the moving balls on the table surface while at the same time one player is aiming to pocket a team ball, and when any uncertainty arises the shooting player is able to ask his or her teammate for assistance.

SUMMARY OF THE INVENTION

Presented is a pocket billiard game called "Moving Billiards" (or "MB") that is played by two teams having at least two players per team. MB can be played on a conventional pocket billiard table with ordinary cue sticks, a cue ball, and a set of object balls that includes striped balls, solid balls, and a specially-marked ball, such as a black "infinite" ball (∞). In some embodiments, a special MB pocket billiard table is used that includes pockets that are wider than conventional billiard table pockets. The MB game includes both team strategy and fast play as team players must calculate angles, take their best shot at moving object balls with a cue ball that may also be moving, and assist their teammate as required (by either suggesting a shot or taking over the shooting responsibility) during play. In particular, MB1 rules require (after the break) having at least one object ball or the cue ball in motion during a turn; if all of the object balls and the cue ball become static (stop) on the billiard table surface then a change of teams is required.

In some embodiments, the MB game includes providing a collection of eleven object balls that includes one specially-marked ball (which can be an infinite ball), five solid color balls, and five striped balls. The object balls are arranged in a rack on the surface of the pocket billiard table, and it is determined that a first team player is to break the rack of object balls. The method includes permitting the cue ball to be struck with a tip of a cue stick by the first team player to break the rack of object balls, and then determining that the solid balls are team balls of the first team because at least one solid ball was at least one of struck directly by the cue ball on the break or pocketed on the break after the specially-marked ball was struck first and before a stripe ball was pocketed, or determining that the striped balls are team balls of the first team because at least one striped ball was at least one of struck directly by the cue ball on the break or pocketed on the break after the specially-marked ball was struck first and before a solid ball was pocketed. The game also requires that the first team players and the second team players pocket at least one team ball during their turn by shooting the cue ball at a team ball while at least one of an object ball and the cue ball is in motion, and requires the first team and the second team to relinquish their turn if at least one of an object ball and the cue ball is not in motion before a shot at a team ball is taken. Lastly, in some embodiments the game requires, after all the team balls have been pocketed, a shooting team player to shoot at and to pocket the specially-marked ball (or infinite ball) while at least one of the cue ball, the specially-marked ball and any remaining object ball(s) is in motion.

It has been found that the movement of the cue ball is important during the course of play of an MB game, and since the cue ball is under control of the shooting team player, the shooting player should intentionally try to manage cue ball motion by using techniques such as top spin so as to ensure that there is always at least one ball in motion. Accordingly, since there is constant motion of the cue ball and the object balls during MB1 play, it would be almost impossible to play MB1 without a teammate.

Thus, the challenge when playing a Moving Billiard game is to position yourself and/or your teammate to succeed in pocketing team balls while at least one object ball and/or the cue ball is in motion, while at the same time avoiding pocketing the infinite ball until after all team balls have been pocketed. The difficulties involved with keeping track of team balls (some of which may be moving while others are static) and calculating angles of attack for striking moving or non-moving team balls with the cue ball require team players to practice shooting a cue ball while at least some object balls are moving.

Advantageously, the rules for playing the Moving Billiards game make for a pocket billiards game that is more challenging than Nine-Ball or Eight Ball (more difficult for a player to run out), and which does not include the defensive strategies that make for slow play in the game of Snooker. In addition, excitement and spectator interest is fostered by MB team player tactics and team play that can be expressed by teams employing special team signs, team communications, team player positioning and/or configurations, and tactics. Because MB is a fast-paced game, in some embodiments players wear special sports clothes that allow freedom of movement to permit sprinting, stretching and reaching, for example, and special flooring (such as an optimized carpet material) can be provided to allow players to move and to change directions quickly while pursuing and taking shots.

BRIEF DESCRIPTION OF THE DRAWINGS

Features and advantages of some embodiments, and the manner in which the same are accomplished, will become more readily apparent with reference to the following detailed description taken in conjunction with the accompanying drawings, which illustrate exemplary embodiments (not necessarily drawn to scale), wherein.

Like numbers in the drawings indicate like elements.

DETAILED DESCRIPTION

Figure 1:
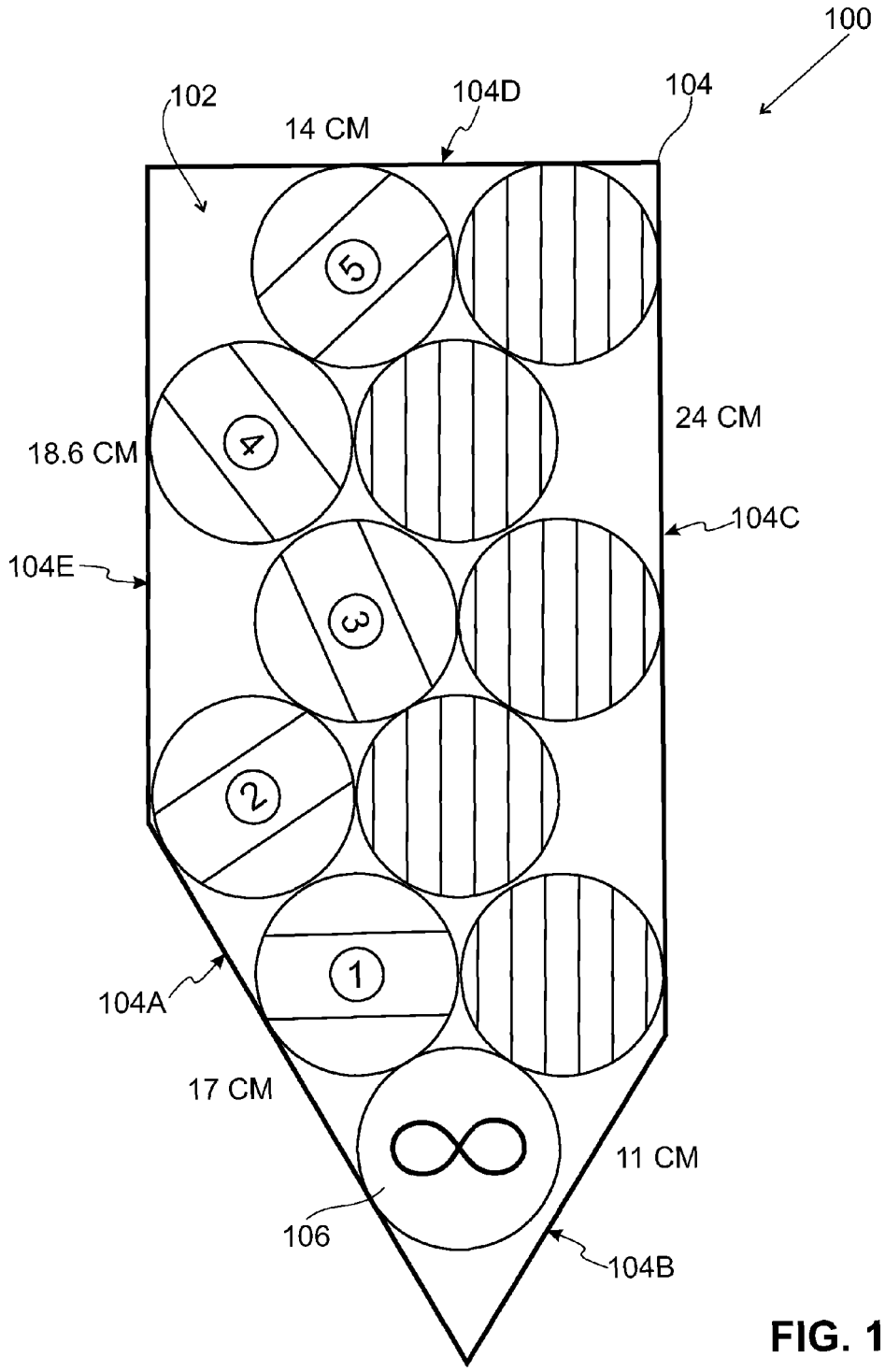
FIG. 1 illustrates a Bolt-shaped rack according to an embodiment of the invention.

FIG. 1 shows an embodiment of some Moving Billiard game equipment 100 that includes a set of eleven pocket billiard or object balls 102 and a Bolt-rack 104. The object balls 102 include five striped balls (here, numbered one through five), five solid-color balls, and a specially-marked ball, here shown as an "infinite" ball 106, that is typically placed within the rack to be located at the head or the apex or in the "pole" or "front" position in the configuration of object balls, as shown. In some embodiments, the infinite ball 106 is typically a solid yellow or black color with a white "infinite" (∞) symbol painted thereon. In some embodiments, standard-size object balls are utilized, which are on average about 5.715 centimeters (about 2.25 inches) in diameter, and weigh from 156 to 170 grams (about 5.5 to 6 ounces). In some embodiments, object balls of various colors are utilized, and the object balls are racked as shown to include the infinite ball 106 at the apex followed by pairs of striped and solid object balls. In some embodiments, all of the striped balls are the same color (for example, all the striped object balls are silver) and all of the solid balls are a different, single color (for example, all the solid object balls are red). In some embodiments, all of the striped balls and the solid balls are the same color (for example, silver), but the striped balls include a white stripe (or another easily recognizable color). In addition, in some embodiments, only the specially-marked ball or "Infinite" ball 106 is black or yellow in color, and may carry the infinity sign (∞) thereon (as shown in FIG. 1).

Referring again to FIG. 1, the stylized, double-bolt rack 104 is a five-sided construction that includes two sides set at an angle to make a point. In particular, the Bolt-rack 104 includes a front long wall 104A that is connected to a front short wall 104B to form a point, and the interior angle (adjacent to the object balls) at the point between the walls 104A and 104B is approximately sixty (60) degrees. The front short wall 104B is also connected to a long side wall 104C, and the interior angle between the walls 104B and 104C is approximately one hundred and fifty-two (152) degrees. The front long wall 104A is connected to a short side wall 104E, and the interior angle between walls 104A and 104E is approximately one hundred and fifty (150) degrees. Both the long side wall 104C and the short side wall 104E are connected to a rear wall 104D and form interior angles of approximately ninety (90) degrees therewith. In an embodiment, the front long wall 104A has an approximate length of 17 centimeters (cm), the front short wall 104B has a length of approximately 11 cm, the long side wall 104C has an approximate length of 24 cm, the rear wall 104D has an approximate length of 14 cm, and the short side wall 104E has an approximate length of 18.6 cm. One skilled in the art, however, would understand that these approximate measurements were calculated to accommodate the size of typical billiard balls and thus can be changed (larger or smaller) depending on the diameter of the object balls that are utilized in the Moving Billiard game. The walls 104A to 104E of the Bolt-rack 104 may have a height of approximately 3.3 centimeters, which corresponds to about half the height plus ten percent of a typical object ball. As shown, the specially-marked ball is located at the apex position followed by a plurality of rows of object balls, which in FIG. 1 is five rows, wherein each row includes two object balls to form a zig-zag configuration that generally mimics a lightning-bolt shape. In addition, each object ball is in contact with at least two adjacent object balls but is always in contact with less than six object balls. Of course, one skilled in the art would recognize that the dimensions, including the height, of a Bolt-rack could be changed to hold more or less than eleven object balls (for example, thirteen or more object balls). The stylized bolt-rack 104 made be made out of wood, plastic, rubber, a composite material, or any other rigid or semi-rigid material capable of supporting or gathering the object balls into the double-bolt configuration as shown.

Figure 2:
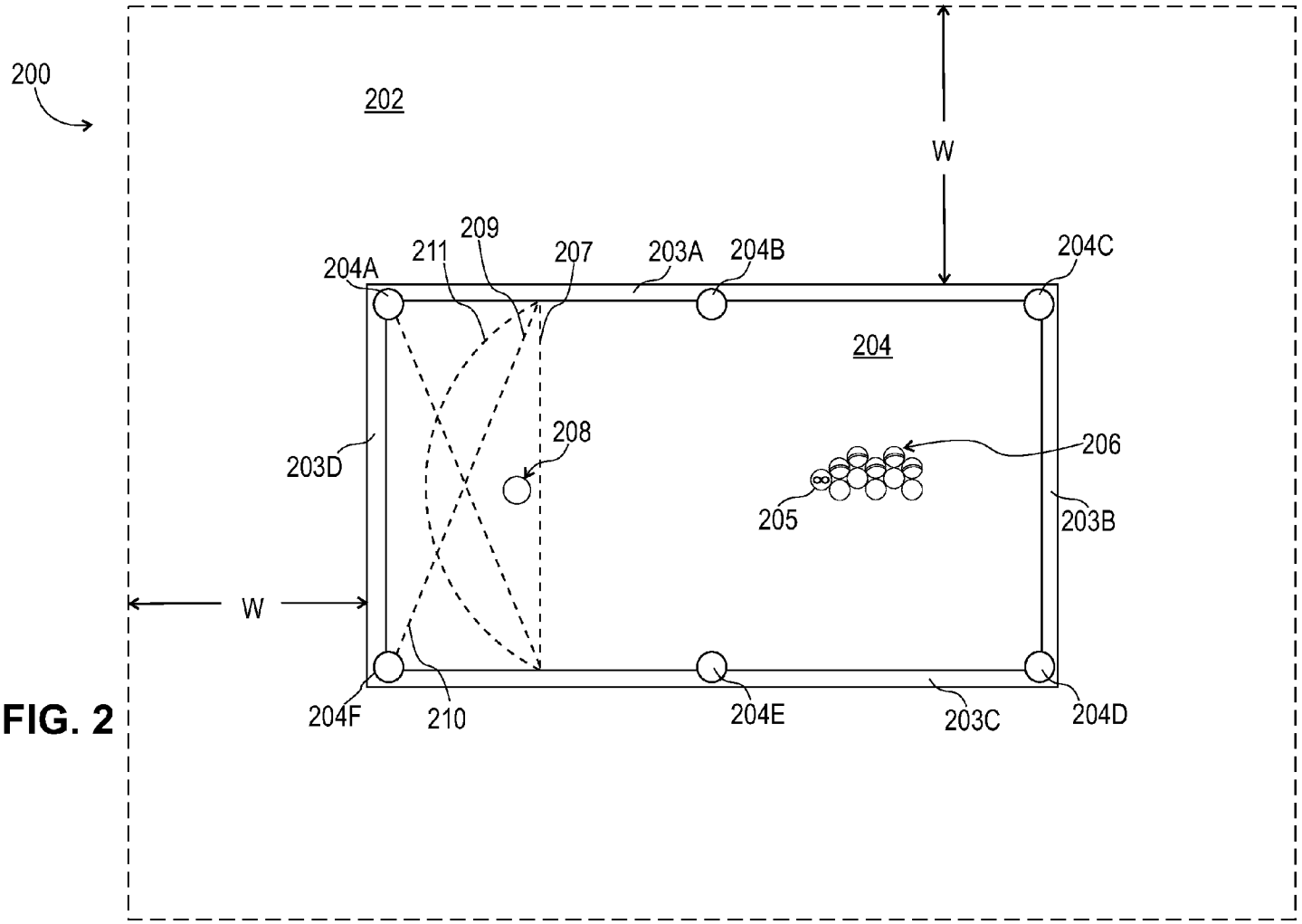
FIG. 2 is a top view of a Moving Billiards play area including a conventional pocket billiard table, not drawn to scale, which also illustrates the bolt-rack arrangement of object balls according to an embodiment of the invention.

FIG. 2 is a top view of a Moving Billiards play area 200, not drawn to scale, that includes a movement space 202 (or a running space) surrounding a conventional pocket billiard table 204 upon which a Moving Billiard game can be played. The billiard table 204 includes four corner pockets 204A, 204C, 204F and 204D arranged at the intersections of the walls or bumpers 203A to 203D, and two side pockets 204B ad 204E arranged in the middle of long side walls or bumpers 203A and 203C, respectively. In some embodiments, the width or diameter of the corner and side pockets is between two and one-tenth (2.1) and two and a half (2.5) times the diameter of an object ball. Depicted on the surface of the billiard table are an arrangement of Moving Billiards object balls 206 and a white cue ball 208. In particular, the object balls 206 have been racked with the Bolt-rack 104 (see FIG. 1) to obtain the shape of a stylized double-bolt configuration at the head of the billiard table 204, and the cue ball 208 has been positioned at the foot of the table behind dotted line 207. In some embodiments, as explained above, Moving Billiard rules specify the use of a total of eleven object balls that include the yellow or black "infinite" ball (∞), a first group of five striped balls that can all be the same color, and a second group of five solid color balls that can also all be of the same color (but a different color than the striped object balls).

Referring again to FIG. 2, the movement space 202 (or running area) extends about the periphery of the billiard table 204 and, in some embodiments, has a width "W" of at least seven feet as measured from each edge (or bumper) of the billiard table 204. Thus, the movement space 202 is wide enough to permit the Moving Billiard players to freely move about the billiard table as play commences and continues (explained below). It is recognized that a billiards room business will need more space than is typical so as to accommodate Moving Billiard game tables (due to the movement space 202), but in the long run it will be worth the investment for such businesses because at least two players per team are required for play and the Moving Billiard game is a fast and tiring team game. Thus, it is contemplated that many players can be accommodated in a short time, and that the billiards room establishment can charge players an appropriate price to be profitable.

In some embodiments, the Moving Billiard game is played by teams that consist of at least two players, although more players could be used per team. For example, Team A consists of two players (Player 1 and Player 2) and Team B consists of two players (Player 3 and Player 4). Referring again to FIG. 2, when commencing a Moving Billiard game, a player from Team A (or a player from Team B) "breaks" the rack 206 of object balls. In some embodiments, the rack 206 must be positioned in a predetermined position or within a bolt-rack area that can be marked on the surface of the billiard table. For example, it may be required that the first row of object balls following the infinite ball (in the pole position) be centered between the two side walls of the billiard table.

Referring again to FIG. 2, in some embodiments just prior to taking the break shot, a player can place the cue ball 208 in any position behind the dotted line 207 which is a first cue ball area defined by line 207, portions of the side bumpers 203A and 203C, and the end bumper 203D at the foot of the billiard table. This area comprises approximately twenty-five percent of the surface area of the billiard table. After placing the cue ball in this area, the player uses the tip of his cue stick to strike the cue ball to send it rolling towards the racked object balls including the black Infinite ball (∞) 205 positioned at the apex of the racked balls.

Also shown in FIG. 2 are dotted lines 209, 210 and 211 which define various additional cue ball areas on the surface of the billiard table (along with the side and end bumpers) for placing the cue ball during play. In particular, a second cue ball area can be defined by dotted lines 207, 209 and 210 that may define a triangular area there-between that a player may have to use when placing the cue ball before breaking a rack of object balls. A third cue ball area could be defined by, for example, portions of the side bumpers 203A and 203C, and the end bumper 203D at the foot of the billiard table along with the circular dotted line 211. In some embodiments, a player would be restricted to placing the cue ball 208 in the second cue ball area, for example, in order to break a rack of object balls or when the "ball in hand" rule is in effect (for example, after an opponent "scratched" by accidently sinking the cue ball). In some other embodiments, a player would be restricted to placing the cue ball 208 in the third cue ball area, for example, when the "ball in hand" rule is in effect. It should be understood that each of the dotted lines 207, 209, 210 and 211 may be an imaginary line, or may be a marking on the felt surface of a billiard table at the foot of the pool table (or billiard table), as shown. The dotted lines 207, 209, 210 and 211 can provide general or specific guides for Moving Billiards players who may be skilled shooters and/or prefer to use a particular strategy when breaking the racked object balls to open a game. In particular, there are many different types of shots that can be attempted, some of which involve using finesse by putting particular spins on the cue ball 208 to, for example, strike an object ball that is located behind the infinite ball 205. A player may develop such an angled shot and use it as part of his or her team strategy, and may use a particular spot along dotted line 207, for example, to set the cue ball 208 before attempting such a shot. Some of such shots may be considered to be trick shots that can involve slow or high-speed striking of the cue ball 208, and/or may involve putting "English" on the cue ball, which means striking the cue ball on either side of its vertical axis to give it "side spin" as it moves forward. The cue ball will thus roll in a slightly curved manner, for example, as it moves to strike the racked object balls 206. ("English" may also occur when a ball collides with another or with a rail.) Skilled players may also use topspin or draw spin, which occurs when the cue ball is struck high or low of center upon its vertical axis. Topspin is used to propel the cue ball forwards after it strikes an object ball, whereas draw spin is used to pull the cue ball backwards after it strikes an object ball. Skilled billiards players utilize such spins as part of their overall strategy, and these skills can also be used by Moving Billiards players.

After impact with the infinite ball on the break, the cue ball and object balls are in motion and the team player must choose his team balls (either striped or solid balls). For example, Player 3 breaks the racked object balls 206 by shooting the cue ball 208 to strike the infinite ball (∞) 205 and to thus scatter the object balls. The team balls assigned to Team B can be randomly decided depending on whether or not one or more object balls of a particular type (solid or striped) are pocketed. For example, if Player 3 pockets a striped ball, then the team balls for Team B are the striped balls. If Player 3 happens to pocket object balls of both types (solid and striped) and does so nearly at the same time then Team B has the option to decide whether to declare their team balls, for example by shooting next at a striped ball (or a solid ball). In this case, the object balls pocketed on the break remain in the pocket. However, when object balls of both types have been pocketed, Team B also has the option to do nothing (not take another shot) and let all of the object balls come to a stop, which results in a change of team (which will be explained below). If Team B makes this decision, then all of the object balls must again be placed in the Bolt-rack 104 (see FIG. 1), and then the MB game will be re-started by the Team A players who come into the movement space 202 to set-up the cue ball and break the rack of object balls.

If Player 3 pockets the infinite ball (∞) 205 on the break, then Team B loses the game. Thus, the break or opening shot can be tricky and perhaps the shooting player does not want to avoid striking the infinite ball. However, if Player 3 strikes the infinite ball (∞) 205 but does not pocket any object balls (or the infinite ball) on the break, then a change of team occurs, and therefore it is time for the players of Team A to enter the movement space 202. For example, Player 2 (of Team A) observes all of the scattered object balls (which are stopped on the billiard table) and he has the option to take his shot based on where the cue ball stopped, or to use the "cue ball in hand" rule. The cue ball in hand rule permits Player 2 to position the cue ball anywhere behind the dotted line 207 at the foot of the billiard table, which can be advantageous depending on the positions of the object balls. In some embodiments, Player 2 may be required to place the cue ball in a defined area, for example, the area between dotted lines 207 and 209 (or 211).

Figure 3:
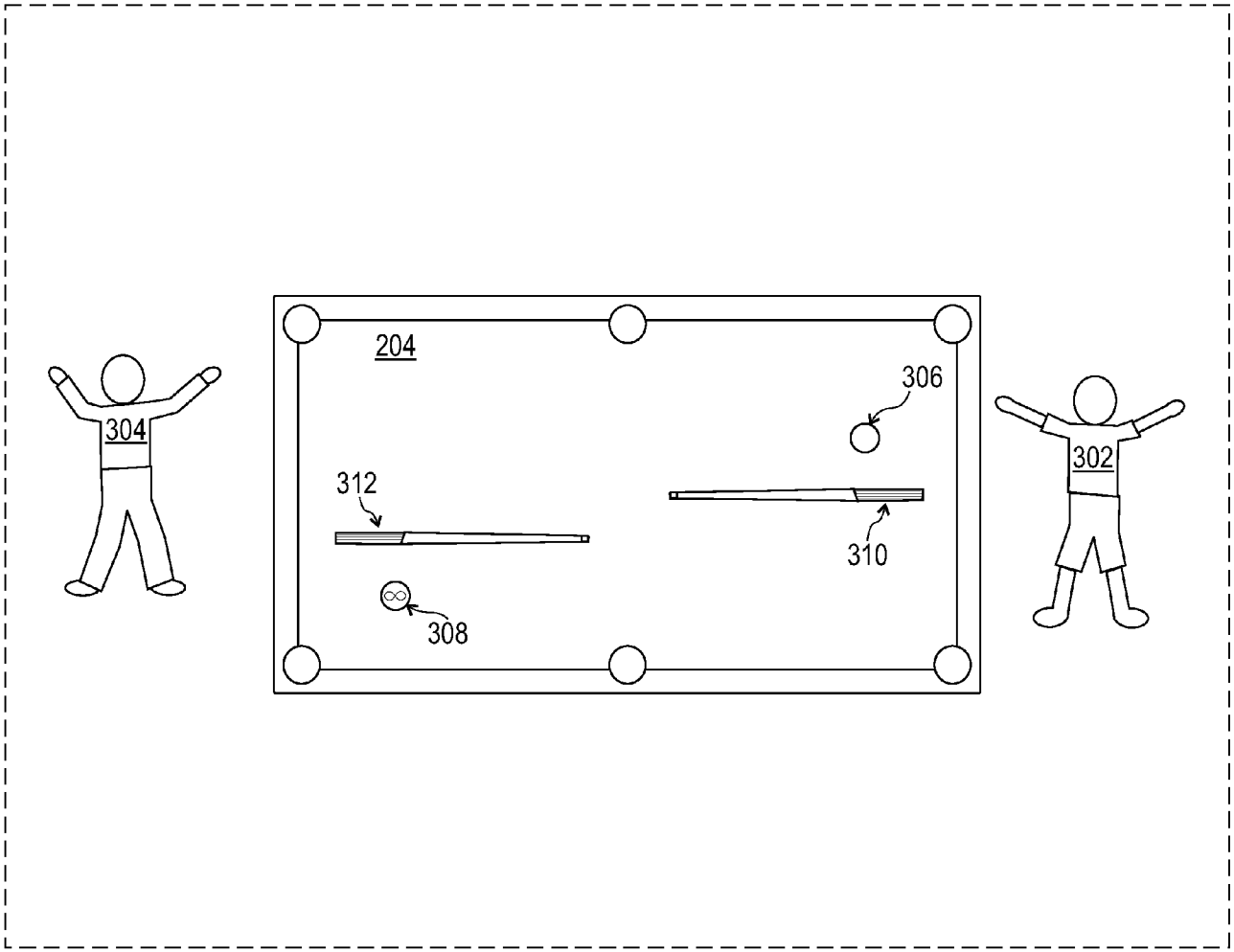
FIG. 3 is a top view of a Moving Billiards play area with a conventional pocket billiards table, not drawn to scale, to illustrate an election method to determine which team will break the racked object balls according to an aspect of the invention.
Figure 5:
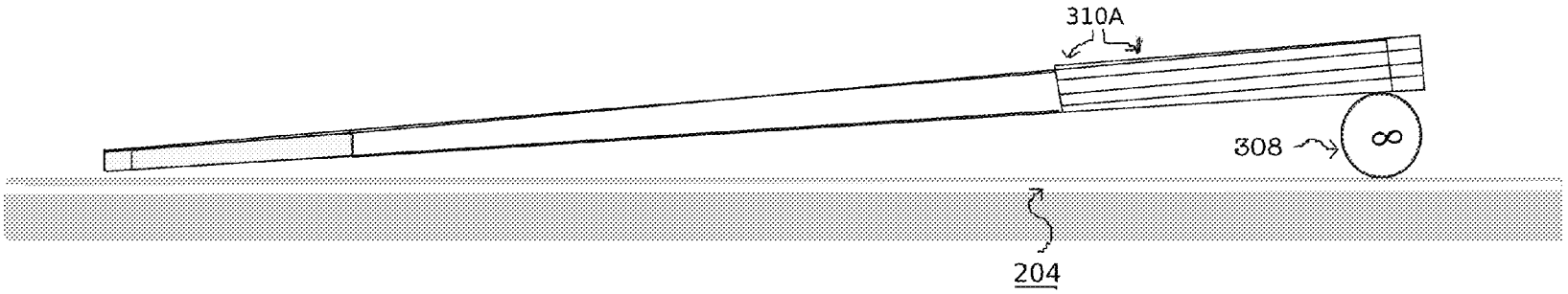
FIG. 5 is a side view of a cue stick, infinite ball and billiard table surface with a heavy end of the cue stick handle resting on the infinite ball to illustrate an election method according to an aspect of the invention.

FIG. 3 is another top view of a Moving Billiards play area 300 including the billiards table 204 to illustrate an election method that may be used to determine which team will break the rack of object balls to begin play. It has been found that, during Moving Billiards play, the more object balls on the billiard table the better because it is then easier for a team player to manage the pocketing of team balls. Thus, it is an advantage for a team to break the racked balls to begin a MB game. As shown in FIG. 3, a player 302 of Team A and an opposing team player 304 of Team B face each other at opposite ends of the billiard table (for example, Team A player 302 is positioned at the head of the billiard table and Team B player 304 is positioned at the foot of the billiard table.) Each player takes one of either the white cue ball 306 or the black infinite ball (∞) 308 and places it on the table surface along with his or her cue stick, as shown. When both players are ready, a referee says "GO" (or otherwise indicates a start) and each player 302 and 304 attempts to balance the heavy end 310A and 312 (thickest portion or handle) of the cue stick onto the top of a ball, as shown in FIG. 5, so that the cue stick remains balanced for a minimum time of three seconds (as counted by the referee). In some embodiments, players can use both hands to control the ball and cue stick, but in other embodiments only one hand can be used. The first player 302 or 304 to accomplish this balancing task wins the election (he or she can choose to break the rack, or to allow the opponent team to do so). In the case wherein both players succeed in balancing their cue sticks on their balls at the same time, then the winner is the player whose cue stick remains balanced on top of the ball for the longest time before dropping onto the surface of the billiard table 202. In the case where both players succeed in balancing their cue sticks at the same time, and their cue sticks both drop off their balls at the same time or do not drop and a predetermined amount of time (such as 60 seconds) expires, then a coin-flip (or some other random method) can be used to decide the winner. In some embodiments, this Moving Billiards "sensitivity" action is required to determine which team breaks the racked object balls.

In some embodiments, a specially-designed MB cue stick can be used that includes a handle made of a rubberized material, wherein the rubberized material is designed to better grip an object ball during the election method described above. In some embodiments, a sleeve made from the rubberized material may be provided for slipping over the handle of a conventional cue stick for such use. Other methods for improving the gripping power of the handle could also be used, for example, a tacky-substance such as "Stickum" could be sprayed onto the handle of a cue stick to improve grip. Stickum is a sticky substance available in an aerosol can or in powder form that can be used to improve gripping power, and athletes in such sports as football, baseball and pole vaulting have used such substances on athletic equipment such as on a baseball bat or a pole vault stick. Other adhesive or "sticky" substances such as glue or rosin (tree sap) could also be used.

Figure 4:
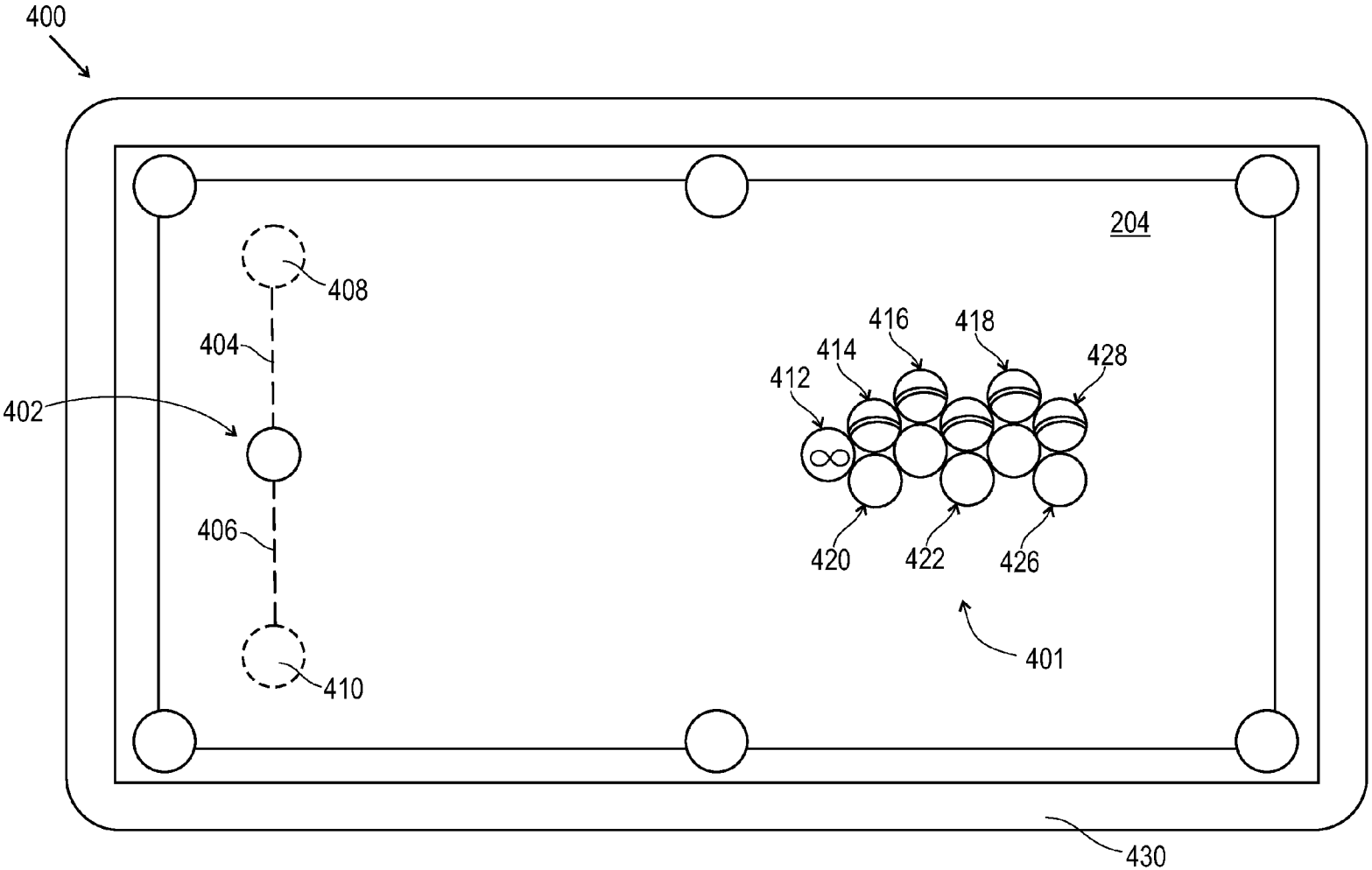
FIG. 4 is an enlarged top view of the surface of a conventional pocket billiards table of a bolt-rack formation of object balls and a cue ball, not drawn to scale, to illustrate player choices for setting up the cue ball to aim at the racked object balls according to an aspect of the invention.

FIG. 4 is an enlarged top view 400 of the surface of an embodiment of an MB billiards table, not drawn to scale, depicting the Bolt-rack formation 401 of object balls and a cue ball 402. As mentioned above, a player has many choices for placement of the cue ball 402, for example anywhere along lines 404 or 406 at the foot of the billiard table, when deciding how to conduct the break (the first shot) of a Moving Billiards game. In particular, the player may place the cue ball 402 in the approximate middle of the table (as measured from the long side bumpers) as shown, or in spot 408 or spot 410 (depicted by dotted lines). His or her decision as to cue ball placement may depend on, for example, the strike angle and/or which object ball he or she would like to strike first. The player may decide to shoot the cue ball 402 straight or directly at the black infinite ball (∞) 412 located at the pole position of the Bolt-rack formation 401, and in this case if any one of the object balls is pocketed then that type of ball (striped or solid) becomes the team ball as explained above. However, the player may decide to shoot at one or the other type of object balls (either the solid or striped balls) which serves to select the team ball type. For example, if the player positions the cue ball 402 at dotted line position 408 and uses his cue stick to shoot the cue ball to strike one of the three stripped object balls 414, 416 or 418, then he has chosen the striped balls as his team balls. Similarly, if the player positions the cue ball 402 at dotted line position 410 and shoots the cue ball to strike at least one of the three solid balls 420, 422 or 426, then he has chosen solid balls as his team balls. As explained above, a skilled player may be inclined to try a "trick" shot, wherein spin is applied to the cue ball 402 by the tip of the cue stick when the player strokes or strikes the cue ball, such that the cue ball 402 rolls in an arc to strike one of the difficult to hit object balls, such as striped object ball 428. The decisions concerning how best to position the cue ball 402 at the foot of the billiard table and which object ball to aim for and hopefully strike is left up to the shooting player and his or her preferences, which may be based on that player's experience with regard to taking a break shot to open a Moving Billiard game.

Referring again to FIG. 4, a rubberized protective bumper 430 is shown around or about the entire periphery of the MB billiard table. The protective bumper 430 may be made of a crushable foam or rubber-like material designed to provide cushioning for players who may accidently crash into or fall into a side of the MB billiards table during play. It is contemplated that during the fast-paced action of an MB game, a player may at some point lose his or her footing (i.e., slip) or lost his or her balance as the player quickly moves or runs in the movement space to take a next team shot. Thus, the protective bumper 430 is designed to absorb impacts to protect MB players from injuring their legs, arms or other body parts. In some embodiments, the protective bumper 430 is removably attached to the MB billiard table, for example, by VELCRO-type fasteners, to allow for easy replacement after prolonged use or to enable cleaning. In some embodiments, a protective bumper 430 is required safety equipment, for example, for use in MB tournament play. In some embodiments a handrail may be included about the periphery of the MB table for use, for example, by players in wheelchairs or on rollerblades to help them move swiftly around the table during play.

Referring yet again to FIG. 4, in some embodiments when the object balls 412-428 are placed on the surface of the moving billiard table to form the zig-zag configuration or pattern, the specially-marked ball 412 is placed on a mark (not shown) on the surface of the billiard table. In some embodiments, the double-bolt arrangement of object balls is positioned such that the distance from an edge of a first positioned object ball in the rack to its closest long-side edge of the billiard table equals the distance of an edge of a second positioned object ball in the rack to its closest long-side edge of the billiard table, wherein the first positioned object ball is one that is located on the outer-most portion of the zig-zag pattern on a first side and the second positioned object ball is one that is located on the outer-most portion of the zig-zag pattern on a second side, opposite the first side. For example, in such an arrangement the distance from the edge of the object ball 416 (or 418) to its closest long-side edge of the billiard table is equal to the distance from the edge of the object ball 420 (or 422 or 426) to its closest long-side edge of the billiard table, which is on the opposite side.

Moving Billiard game rules require that, after the break, the team player shooting the cue ball is required to pocket one or more of only his or her team balls as at least one object ball and/or the cue ball is moving (rolling) on the surface of the billiard table. In addition, only the two team players who are currently shooting at team balls can walk or run within the movement space (running space) at the same time, but only one of them can shoot at and pocket a team ball while one or more of the other object ball(s) or cue ball is/are still moving on the billiard table. If at least one object ball or the cue ball is not moving when the player attempts a shot (that is, all the balls on the billiard table have stopped rolling), then a foul has been committed and then it is the opposing team's turn to shoot. In addition, by rule during Moving Billiards play, a team player must shoot the cue ball to first contact a team ball or else a foul has been committed and play turns over to the opposing team. A particular team can continue to play as long as a team ball is legally pocketed and one or more object balls are in motion.

For example, while Team A (Player 1 and Player 2) is playing, the two players of Team B (Player 3 and Player 4) cannot be in the movement space but must be observant and ready to employ their team strategy quickly if Team A commits a foul. In addition, with the exception of the break or a change of turns, at least one object ball or the cue ball must be in motion in order for the Team A player to take a legal shot at one of his team balls. If this is not the case, then a Moving Billiard foul (a "static" foul) has occurred and it is time for Team B to take a turn at play. For example, in a situation in which the team balls of Team A are "striped" balls immediately after the break (and thus the team balls of Team B are "solid" balls), Player 1 can legally shoot at a striped ball as long as one or more object balls (and/or the cue ball) are in motion at the time of the shot or else a foul has occurred. In some embodiments, a "second-chance" rule is in effect which permits Player 1 to take another shot after failing to sink a team ball immediately after the break shot (that is, Team A has two tries to sink a team ball immediately after the break shot). Under the "second-chance" rule, if Player 1 (or Player 2) fails to sink a striped ball after two tries following the break shot, then a foul has occurred and Team B gets a chance to shoot. It can be easily understood, having the cue ball in motion at the time a shot is attempted, although legal, adds to the degree of difficulty in making the shot (but it also prohibits a static foul from occurring). After all of the team balls have been pocketed legally (for example, Player 2 sinks the last remaining "striped" ball) then that team (Team A in this example) can attempt to pocket the infinite ball. The team that first legally pockets the infinite ball after all their team balls have been pocketed is the winner of the MB game.

For example, during a turn Player 1 (Team A) can move around the billiard table in the movement space 202 (See FIG. 2) as Player 2 (Team A) is also moving in the movement space. Player 2 can talk to or signal to his teammate regarding the positions of the team balls (striped balls) and possible shots that Player 1 could take. As part of the playing strategy, Player 1 can relinquish the shooting responsibility to his teammate, Player 2, if and/or when it appears that Player 2 has a good chance (or a better chance) to pocket a team ball. In some embodiments, due to the movement of team players and the overall speed of play, a referee may be utilized (or may be necessary) to keep track of play and to spot and to call Moving Billiard fouls. For example, Player 1 commits a Moving Billiard foul by failing to take a shot while at least one object ball (or the cue ball) is in motion which causes the referee to call a foul that results in a change of teams. Consequently, in this example, Player 1 and Player 2 must leave the movement space so that Player 3 and Player 4 of Team B can enter the movement space (running space) to survey their object balls (the solid-colored balls) on the table before attempting a shot. As mentioned above, as Moving Billiard play commences and continues, only players of one team are permitted to move about inside the movement space 202 (running space) while attempting shots, and only one player is permitted to shoot the cue ball to strike and to hopefully sink a team ball at a time.

In some embodiments, however, all team players (from both Team A and Team B) are permitted in the running or movement space at the same time. In such a case, one or more special blocking rules may be in effect that require a player to move away from the side of the billiard table (or otherwise get out of the way) to permit the opposing team players to have unimpeded access to the cue ball and object balls during play. Such a method of play allows a quick change in the shooting team to occur when, for example, a Team A player commits a foul other than a static ball foul so a Team B player can shoot while one or more object balls and/or the cue ball are still moving on the surface of the MB table.

In some embodiments, Moving Billiards players must call the pocket that they intend to shoot for when attempting to pocket one of their team balls. Referring to FIG. 2, for example, Player 1 of Team A may call out: "Striped ball in the side pocket (204B)" and/or make a head gesture or finger point to that pocket, or otherwise indicate which pocket he is shooting for, just before stroking the cue ball with his cue stick to shoot at the striped team ball. Thus, a Moving Billiards game in progress may feature team players focusing and shooting the cue ball at one of their team balls with the goal of pocketing that ball in a called pocket, while at the same time at least one of the object balls and/or the cue ball is in motion. During this time, for example, Player 2 of Team A is observing the situation and trying to move to an optimal position to either aid Player 1 or to take a shot himself as the object balls move on the table. Thus, a team partner waits for the right time to be of assistance and/or to take one or more shots for the team as the opportunity arises. For example, it is advantageous to have multiple object balls in motion during play to both make it easier for the shooting player to find a good shot and to minimize game pressure (because there is less chance that the object balls will become static). Thus, the non-shooting team player may talk out loud or gesture or otherwise communicate with the shooting player concerning the overall condition of the object ball movements on the billiard table and which team ball may be easiest to pocket. Accordingly, there is always one shooting player and another observing and/or assisting team player and at least one of them can call a pocket for the shooting player (although the shooting player typically is the player who calls the pocket for a particular shot). In case the shooting player calls a first pocket and his other team player calls a different, second pocket during a shot, then the "MB code of honor" rules are in effect, and in most cases it will be the pocket called by the shooting player that will be taken as the called pocket. Since Moving Billiards ("MB") is a fast-paced game that includes quick player reactions, object ball(s) movement, and requires the shooting player to call a pocket when attempting to pocket a team ball, in some embodiments an "MB Code of Honor" for each player on each team is in effect. For example, players participating in a Moving Billiard tournament must declare that they have read and understood the MB Code of Honor and will adhere to its requirements. In particular, the MB Code of Honor requires a shooting team to indicate in the clearest way possible the intended pocket for legally sinking a team ball (or the infinite ball). Any abuse of this rule may result in disqualification of the player from the tournament, and may include exclusion of that player from playing in one or more future Moving Billiard tournaments. Such a rule can be important to the integrity of the Moving Billiards game because only the shooting team player knows his intentions in a particular shooting situation, and he or she is the only person that knows for certain if the correct pocket was called before the shot. Thus, if there are any reasonable doubts regarding the pocket that was intended (perhaps due to the direction the cue ball was struck, or because of the direction in which a team ball was headed, and/or because of the pocket into which a team ball was pocketed) any doubts must be cleared up by invoking the MB Code of Honor such that the shooting player formally states his or her intention. It should be understood that the MB Code of Honor can and should govern all Moving Billiards games, but it is especially important for tournament play.

In view of the above description, it is clear that team players have to coordinate their Moving Billiards play and talk to each other or otherwise communicate (for example, by using hand signals and/or facial expressions) their intentions and/or actions while running around the movement space and while focusing on the object balls that are on the billiard table. The shooting team player also must concentrate and focus on the moving balls on the table while aiming at the cue ball in order to pocket one or more team balls with the cue ball, and may need to ask his or her partner for assistance, for example by turning over the shooting responsibility. Furthermore, the Moving Billiard game lends itself to tactical double team play that could include organized secret and/or open communications concerning team strategy. Team balls are constantly changing position during a Moving Billiards game, and thus special tactics and techniques can be utilized by players to win the game by attempting to sink all of their team balls legally and then sinking the infinite ball on the last shot. In addition, it is often the case that the cue ball remains in motion while attempting a shot at a team ball, which in many cases makes it necessary to have a good partner (team player) to take a shot from another end or side of the billiard table, for example, as circumstances present themselves. This also means that the team players must trust each other and work as a team (or as a couple) to assist and support each other as players are expected to fail at times. Furthermore, due to the fast pace of an MB game, there is no time for a player to explain a situation or to direct a teammate, so a "blind" or inherent team-understanding may become necessary during play. In other words, team players must not only have a "feel" for the MB game but also must anticipate and/or understand each others' mode or style of play in order for the team to be successful.

As mentioned above, the Moving Billiard game is won when a team player legally pockets the black infinite ball (∞) after all of his team balls have been pocketed. For example, after pocketing his last team ball, Player 1 (Team A) can motion to the black infinite ball and point to the corner pocket 204F as the infinite ball and/or the cue ball is/are in motion, or while any of the other object balls on the table are still in motion, and then take the shot. If the shot is successful, then Team A wins the game. If Player 1 sinks the infinite ball in a different pocket or scratches (inadvertently pockets the cue ball), then Team A loses the game. But if Player 1 completely misses the infinite ball (the cue ball does not strike it) or if the infinite ball and cue ball become static before he shoots or after he strikes the infinite ball, then a foul has occurred and play passes to Team B. Continuing with this example, if Player 3 of Team B (after the foul of Team A) fails to make a legal shot at a team ball so that a change in teams is necessary, then since the object balls are static and only the infinite ball remains for Team A, then Player 1 (or Player 2) is not permitted to just call a pocket, aim and then shoot the static cue ball at the static infinite ball; instead there are two ways that the Team A players can proceed. The first, lower skilled procedure, is for Player 1 (or Player 2) to tap the cue ball in the general direction of the infinite ball such that the cue ball is rolling, and then while the cue ball is still in motion Player 1 (or Player 2) must again shoot it at the infinite ball so that the infinite ball is pocketed in a called pocket to win the game. The second, higher skilled procedure, is for Player 1 to shoot at and contact the infinite ball with the cue ball such that both the infinite ball and the cue ball are in motion (at least initially) and then while one or both are still in motion, to attempt a game winning shot (by calling a pocket for the infinite ball) by shooting the cue ball to strike the infinite ball so that the infinite ball falls into the called pocket. Thus, in both cases, Player 1 has to attempt to pocket the infinite ball while one or both of the cue ball and/or the infinite ball are in motion (both cannot be static). In other words, at least one ball (here, the cue ball) must be in motion as Player 1 (or Player 2) takes her shot at the infinite ball in an attempt to win the MB game.

Player skill is demonstrated when all team balls have been pocketed to leave just the cue ball and the last object ball, which is the black infinite ball, because it is very challenging to calculate, to shoot and to pocket the infinite ball while the cue ball is still in motion. In the highest concentration type situation both the cue ball and the infinite ball are in motion and the player must shoot quickly before the cue ball stops in the case where it is clear that the infinite ball will not stop first, or because it is clear that the infinite ball is in an optimal position for pocketing even though it is in motion. In such a case, depending on the speed of the infinite ball and the cue ball, the team player taking the last shot has to predict and calculate the optimal contact-point of the cue ball and the infinite ball to angle the infinite ball into a called pocket. Furthermore, the shooting team player may be tired after running around the billiard table taking shots, which adds to the degree of difficulty of making a legal shot. Accordingly, due to the fast pace of the game and the need to quickly change positions around the billiard table during play, team players should not only practice shooting in their spare time before playing, for example, in a Moving Billiards tournament, but should also do conditioning exercises and practice strategy, tactics, and communications with their team mates. For example, secret team signs, codes, instructional phrases, and team formations are allowed and are often necessary to play Moving Billiards at a high level and thus need to be practiced. In addition, team players should practice how they will be positioned around the billiard table during play. For example, a standard formation is to position each team player diagonally across from one another such that each of the two team players are at opposite corners (opposite ends) of the billiard table during play. This allows for a team player to quickly move to an optimal shooting position in the shortest time without being inadvertently blocked by his or her teammate as both players move in the movement space. But the playing team must still decide when and where and how often (depending on their, for example, conditioning, skill level, playing style, concentration skills, and other attributes or circumstances) a particular team player will shoot or relinquish shooting and become the observer as play continues.

As described above, the MB game requires some skill, and although it seems to be a bit complicated, in practice Moving Billiards is fun to play and players pick up the necessary skills and rules of play rather quickly. In addition, the team player aspect helps individual players get a feel for the game because at least one teammate is available to assist with MB game activities such as lining up shots at team balls and taking over the shooting responsibility when appropriate. Part of the fun of playing Moving Billiards also accrues as teams play more and more MB games and become familiar with each others' style of play and as the team plays by using strategies that they have developed.

Rules and/or Fouls of the Moving Billiard Game are as follows:

1. The black infinite ball (∞) cannot be pocketed by a team player unless all of the team balls have already been legally pocketed by that team. In addition, in such case the player taking aim to sink the infinite ball must indicate the pocket (for example, the corner pocket 204D of FIG. 2) into which the infinite ball will fall. If the infinite ball (∞) is pocketed in a different pocket than the one that was called, then that team losses the game. For example, if Player 1 calls the infinite ball in the side pocket and it falls into a corner pocket instead, then Team A losses the game. However, if for example Player 1 (Team A) calls the infinite ball in a side pocket 204B but fails to sink it, then play passes to Team B and Team A may get another chance to later win the game. If a shooting player inadvertently pockets or sinks the infinite ball before all team balls have been pocketed, then that Team loses the game.

2. If a player pockets a team ball in a billiard table pocket that was not indicated or called by that player (with the exception of pocketing one or more object balls on the break of the rack of object balls to start the game), or if a team ball or the cue ball jumped the billiard table side rails and landed on the floor (in the movement space), then that team ball must be replaced on the billiard table. In addition, a change of teams is compulsory. The ball(s) may be placed in a pre-arranged position on the billiards table, or may be placed in a location that is decided at the discretion of a referee.
3. A team player may not strike the cue ball to jump off the billiard table (or to jump the cue ball in general) on the opening shot of the Moving Billiard game (to break the rack of balls). If this occurs, the object balls are re-racked and a player from the opposing team is permitted to take the first shot of the game. However, a player is permitted to jump the cue ball, for example, over any object ball during other play but only if the cue ball and all of the object balls remain on the billiard table and/or a team ball ends up in the billiard table pocket. If any of the cue ball or object balls falls off the table onto the floor, it is a foul with the consequences that the ball(s) that fell off the table are replaced on the billiard table surface and the turn passes to the opposing team. Again, the ball(s) may be placed in a pre-arranged position on the billiards table, or may be placed in a location that is decided at the discretion of a referee.
4. Any disturbance designed to obstruct or break the concentration of a player who is attempting to take a shot by an opposing team player or a spectator is a foul. In addition, any "act of God", such as an earthquake or other disturbance, that breaks the concentration of a player is treated as a foul. In such cases the shooting player may call a 1-minute (one minute) timeout (or longer, depending on the circumstances). If the referee decides that the timeout is warranted or justified, then the player who called the timeout (or his teammate) continues the game after a minute expires with the object balls and cue ball in the set or static position. If the referee decides that the timeout was not justified, then a change of teams is mandatory, and with the object balls in a set position the opposing team player enters the moving space to take his turn. In this case when there is a change of shooting team, the shooting team player has the option of utilizing the "ball in hand" rule, which permits the shooting player to place the cue ball anywhere behind an imaginary line (see FIG. 2, for example, reference number 207) at the foot of the billiard table. In some embodiments, the shooting player must place the cue ball along or behind a designated area (for example, along or behind line 207, or line 209 or line 211), which may depend upon use of a particular set of MB tournament rules.

If the player calling a legal timeout pocketed a team ball then the team ball remains in the pocket. However, if an opponent team ball or the cue ball (or inadvertently the infinite ball) was pocketed, then that (or those) ball(s) is/are replaced on the table, which may be on a predetermined position within a MB double bolt rack area.

If the player calling a legal timeout was legally shooting at the infinite ball (∞), then that player has the option of either continuing the Moving Billiard game by replacing any pocketed opposing team balls on the table and again shooting at the infinite ball or to be declared the winner of the game. A skilled team will opt to shoot again at the infinite ball by using the procedure explained above, wherein the player will tap the cue ball in the general direction of the infinite ball such that the cue ball is rolling, and then while the cue ball is still in motion shoot it at the infinite ball so that the infinite ball is pocketed in a called pocket to win the game. Alternately, the shooter could shoot at and contact the infinite ball with the cue ball such that both the infinite ball and the cue ball are in motion (at least initially) and then while one or both are still in motion, to attempt a game winning shot (by calling a pocket for the infinite ball) by shooting the cue ball to strike the infinite ball so that the infinite ball falls into the called pocket. In the case where the shooting player calling a legal timeout did pocket the infinite ball in a called pocket (or even in some other pocket) then his team is declared the winner of the MB game.

5. After the break, any direct cue ball shot (including by using the bumper(s) of the billiard table) to strike an opponent's team ball before striking one's own team ball (or the "Joker ball") is a foul, and the penalty is that the teams change. In addition, any touching during play of any of the cue ball or the object balls with other than the tip of the cue stick (such as by the player's hands or fingers or clothes) that results in a significant change of position(s) is a foul, and the teams change (the shooting team loses its turn).
6. While shooting the cue ball during Moving Billiard play, the shooting player must contact the floor of the moving space around the billiard table with a portion of at least one foot or arm or a rollerblade or wheelchair, for example (i.e., at least one shoe or hand or wheel must be in contact with the floor). Thus, no player can have his entire body supported by the surface of the billiard table (either by sitting on or by lying on the table).
7. The cue ball must remain on the billiard table surface at all times during MB play. If a team player sinks the cue ball during a shot, then a change of teams is necessary and the cue ball is placed anywhere behind an imaginary line located at the foot of the billiard table by the opposing team player.

If the cue ball is pocketed inadvertently by a team player legally shooting at the infinite ball to win (end) the game, then that team lost the game even if the infinite ball is pocketed in the called pocket. The only exception to this rule is that if a legal timeout was called (for example, due to a disturbance) then the team player does not lose the game for her team.

If the white cue ball is pocketed and during the same shot a team ball is also pocketed, then both the cue ball and the team ball are replaced on the billiard table and a change of teams occurs.

If the white cue ball is "jumped" during a shot and does not end up on the surface of the billiard table, then it must be replaced within a predetermined cue ball area.

8. Nasty behavior and/or the use of foul language (such as obscene words) by a team player during a Moving Billiard game is a secondary foul. After the game ends the referee or any other team player may issue a warning notice. In some embodiments, the warning notice is made public and/or stated by a referee such that the spectators can hear it so that it is understood that such bad behavior did not go unnoticed. In some embodiments, such a warning notice may be placed on a player's record and, if that player accrues some threshold amount of warning notices, may lead to suspension of the player for a period of time from playing in one or more MB tournaments.

In some embodiments, a Moving Billiards "Joker Ball" rule is in effect, which allows a shooting player to strike the infinite ball (which is now the Joker Ball) with the cue ball such that neither ball is pocketed, or such that a team ball is pocketed, or to better position the infinite ball for taking a winning shot. A player may use this tactic to "buy" time by setting up a "MB Time bridge" to slow down the game, at least from the perspective of the shooting player, or to speed up the game by avoiding having the object balls come to a stop. In addition, the Joker Ball can be used by the shooting player to orient the cue ball in a better position to pocket a team ball, and the Joker Ball can be used to pocket a team ball if the shooting player first calls the pocket for the team ball (e.g. instead of directly shooting at and attempting to sink that team ball). However, using the Joker Ball rule is a high risk maneuver because if the shooting player accidently pockets the infinite ball (which is the Joker Ball) then his team loses the game. Thus, using the Joker Ball rule is both tempting and high risk at the same time so each team player must be careful when deciding if he or she will take that risk.

During Moving Billiard tournament play, a rule may be in effect that limits the use of a Joker Ball to only once per play and/or only once per team player. In addition, the rule for advanced team players may be that the Joker Ball can be used only three times per team and per game. For all other team players the Joker Ball can be used up to three times per game and per team player. Conversely, a rule could be in effect that forbids striking the black infinite ball (∞) with the cue ball directly (unless all team balls are already pocketed), which means that the Joker Ball rule is not in effect. Of course, other variations of the rules described above may be used to limit the use (or not) of the Joker Ball.

The Moving Billiard game requires concentration as the situation is always fluid and changing as object balls roll about the billiard table. Since high speed billiard techniques are needed, there is time pressure on players to target and shoot at team balls while object balls and/or the cue ball is/are moving. Therefore, if there are any disturbances of the MB game caused by spectators or by the players from the other team during play then, as mentioned above, the shooting player is allowed to take a timeout. The referee then decides whether or not a called timeout was warranted. If the referee rules that the timeout was not justified, then the team that called the timeout relinquishes the billiard table to the other team (that is, the team that called timeout loses their turn). For example, if a spectator coughs as Player 2 (Team A) is lining up a shot and Player 2 calls for a timeout, the referee may disallow it (for example, if the cough was muffled and was not disturbing). In this case, play passes to Player 3 or Player 4 (Team B), the Team A players must vacate the movement space, and any balls pocketed by Team A (their team balls and/or the infinite ball and/or the cue ball (if not on a winning shot try, because then Team A would lose the game)) must be replaced, but in some embodiments any Team B object balls that were sunk remain pocketed. In another example, if Player 1 (Team A) was lining up a winning shot at the infinite ball, and Player 4 loudly calls out to his teammate in a manner designed to disturb Player 1, then Player 1 would be justified in calling a timeout. In this case, the referee may declare Team A the winner of the game but only if Team A agrees with the referee. In this situation, Team A instead may elect to attempt a shot at the infinite ball to win the game in the manner described above, such that at least one of the cue ball and infinite ball are in motion ("second chance" shot) when the player is shooting to pocket the infinite ball in a called pocket.

In other situations, the shooting player who has been disturbed can be granted a timeout that lasts several minutes to compose himself or herself before resuming play. If the disturbing event occurs during a Moving Billiard tournament, for example, the timeout may be limited to one minute. In any case that a legal timeout was called, the shooting player resumes play by observing the static positions (resting positions) of the object balls on the billiard table surface and then either lines up a shot from where the cue ball stopped or may take the "cue ball in hand" and position it behind the imaginary line (see FIG. 2) at the foot of the billiard table and then take a shot, which options may be granted at the discretion of the referee. The timeout rule forces spectators and opposing team players to stay disciplined and to show good sportsmanship by exhibiting good behavior.

In some embodiments, the Moving Billiards rules require team players to alternate the shooting responsibility during play after each shot to ensure that shooting players change as much as possible. For example, Player 1 of Team A breaks the racked object balls and, while the object balls are in motion a striped ball is pocketed so that the team balls for Team A are striped. Next, Player 2 of Team A must shoot at the striped (team) balls while at least one object ball is still in motion, and if he succeeds in pocketing a striped ball then Player 1 must take the next shot. Thus, team players alternate shooting responsibility as long as they are successful in pocketing team balls. In addition, it is contemplated that in some embodiments, the team players for both Team A and Team B will all be using the movement space around the billiards table at the same time with rules in place to forbid a player from one team from obstructing or otherwise blocking the path of a team player from the other team during play.

Furthermore, it is contemplated that Moving Billiards rules books and training manuals (to include strategy and tactics instructions) will be published to aid players and to govern Moving Billiards tournament play. Furthermore, it is contemplated that special Moving Billiards tables and cue sticks optimized for Moving Billiards play will be produced. For example, a Moving Billiards table may have different dimensions than a standard pocket billiards table; in particular, the pockets themselves can be slightly larger to make it slightly easier to pocket object balls during play. For example, each pocket may be 2.1 (two and a tenth) to 2.5 (two and a half) times as wide as the diameter of an object ball. Optimized cue sticks can also be designed, for example, that are light-weight and that have cue stick tips that are slightly larger or made from a material (for example, leather) that may hold chalk longer than a conventional tip because it is envisioned that during the play of Moving Billiards players typically do not have time to chalk the cue stick tips. In some embodiments, shooting players may attempt to take shots behind their backs and thus specially-designed cue sticks may be used to facilitate such "trick" shots. For example, cue sticks of longer than average length with special grips and having smooth shafts to smoothly interact with clothing could be provided. In addition, with regard to the election method described above, cue sticks that are balanced to have a handle a bit heavier than normal and with a somewhat tacky surface (or a sleeve with a tacky surface designed to fit over the handle) to aid in balancing on an object ball or cue ball could be provided.

In addition, the running space around the billiards table can be optimized to be made of a flooring material (for example, a special carpet) to aid traction so that players can safely stop and change direction easily without injuring themselves (for example, without hurting their legs and/or knees). In situations where an MB table is located outside, for example, an artificial grass surface (or artificial turf surface or similar material) could be used as a flooring material, and players would wear appropriate footwear. Yet further, special Moving Billiards shoes may be produced, for example, to be light weight and to have good traction, and special Moving Billiards clothing (e.g. loose-fitting shirts and/or blouses, or tight-fitting outfits, and the like) can be manufactured. In addition, MB game footwear, could be provided that includes one or more notches for supporting a cue stick to aid a player in taking shots and has a sole. In this case, a shooting player could balance his shoe (for example, by placing the heel of the shoe on a side bumper of the billiard table) and use a notch located near his big toe to guide his cue stick, over the top of one or more object balls to enable him to strike the cue ball in a desired direction. Of course, current players can use common sports sneakers and sports clothing to play Moving Billiards. For example, referring to FIG. 3, player 302 is wearing a short sleeves shirt and shorts and player 304 is wearing a long sleeves shirt and long pants, which outfits may comprise typical sportswear. But specially designed MB sportswear is contemplated that, for example, includes perspiration-wicking properties and a loose fit for player comfort. Such MB sportswear would also provide a wide range of motion so as not to impede player shots during MB games. In addition, it is contemplated that special MB sports drinks (primarily non-alcoholic) can be mixed and served at a Moving Billiards Sports Bar that may be located near the billiard tables.

It is also contemplated that one or more modifications could be made to aspects of the moving billiards game equipment to accommodate different types of players. For example, older MB players may have difficulty in keeping up with the speed of an MB game. Thus, in this case, heavier object balls and/or a higher friction table surface material could be used to slow down the object balls and cue ball rolling speed to make it easier to line up and take shots during an MB game. The cue ball and object balls could also be made of a higher-friction material so that these balls don't roll as fast on the felt surface of a typical billiards table. In another example, to accommodate handicapped players in wheelchairs the MB table can be lowered so that such players can access the table top, and the width of the movement space (or running space) can be increased to permit free movement of a wheelchair about the MB table. Specially designed handles or handrails, for example, could also be located about the MB table like a rail for grasping, and such protrusions and/or rails may include a protective covering to prevent injuries. The surface material of the flooring in such situations could also be changed to accommodate wheelchair wheels. In another example, the object balls and/or cue ball could be modified to emit, for example, flashing light and/or sounds, so that for example sight impaired players can play the game. Conversely, nearly transparent object balls could be used to either increase the degree of difficulty of MB game play, or to aid players with extra-sensitive eyesight. In some such embodiments for example, object balls of a first team color emit blue light while object balls of a second team color emit red light and the cue ball emits white light to easily distinguish between them. Similarly, the object balls of the first team emit a high-pitch sound, for example, while the object balls of the second team emit a lower-pitch sound and the cue ball emits a wavering sound so that they can be easily distinguished. In addition, the sounds and/or colors can change depending on whether or not, for example, an object ball is struck by the cue ball or is bouncing off of a bumper or is dropping into a pocket, or can change depending on the rolling speed of the ball. Accordingly, various different types of light and/or acoustic combinations are contemplated and can be used in any desirable combination. In yet another embodiment, the movement space can be specially configured to accommodate players on roller skates or rollerblades competing in a specialty-type of MB game. Accordingly, it should be understood that many different types of accommodations can be made to the MB table, MB sports equipment, and to the movement space to fit particular circumstances and to ensure that all ages and character (or types) of persons can play an MB game.

The game methods described herein have been indicated with reference to Moving Billiards rules that govern the flow of the game. However, certain rules can be invoked in an arbitrary manner, or in some cases can be ignored, such as when players of both Moving Billiards teams agree not to enforce one or more of the certain rules (for example, the "Joker Ball" rule may not be used during certain games).

It should be understood that various combinations, alternatives and modifications of the present invention could be devised by those skilled in the art. Accordingly, the present invention is intended to embrace all such alternatives, modifications and variances that fall within the scope of the appended claims.

What is claimed is:

1. A five-sided ball rack comprising:

a front long wall and a front short wall forming an apex therebetween with an interior angle of approximately sixty degrees;

a long side wall connected at a first end to a first end of the front short wall to form an interior angle of approximately one hundred and fifty-two degrees;

a short side wall connected at a first end to a second end of the front long wall to form an interior angle of approximately one hundred and fifty degrees; and a rear wall connected at a first end to a second end of the long side wall and connected at a second end to a second end of the short side wall to form interior angles of approximately ninety degrees therewith.

2. The five-sided ball rack of claim 1, wherein each of the walls have a height of approximately half a height of an object ball plus ten percent of the height of the object ball.

3. A method for playing a moving billiards game, comprising:

arranging eleven object balls including a marked ball in a stylized rack on a surface of a pocket billiard table having at least six pockets, wherein the stylized rack comprises a five-sided frame wall construction comprising:

a front long wall and a front short wall forming an apex therebetween with an interior angle of approximately sixty degrees, a long side wall connected at a first end to a first end of the front short wall, a short side wall connected at a first end to a second end of the front long wall, and a rear wall connected at a first end to a second end of the long side wall and connected at a second end to a second end of the short side wall to form interior angles of approximately ninety degrees therewith, and wherein the rack is configured and sized to provide a stylized double-bolt arrangement of eleven object balls comprising a marked ball at an apex position followed by five rows that includes two object balls in each row forming a zig-zag configuration;

positioning the stylized rack in a bolt rack area marked on the surface of the billiard table;

determining that a team player of a first team or of a second team is to break the rack of object balls with a cue ball, wherein the first team comprises at least a first player and a second player and the second team comprises at least a third player and a fourth player;

removing the stylized rack from the surface of the pocket billiard table revealing a stylized arrangement of object balls in a zig-zag configuration;

breaking, by an elected team player, the zig-zag configuration of object balls by striking the cue ball with a tip of a cue stick to direct the cue ball to strike at least one object ball of the zig-zag arrangement;

legally pocketing one or more team balls during a shooting turn by shooting the cue ball at a team ball while at least one of an object ball and the cue ball is in motion;

relinquishing a shooting turn when at least one of an object ball and the cue ball is not in motion before a shot at a team ball is taken;

relinquishing a shooting turn when a team ball is not pocketed after a legal shot has been taken; and winning, after all the team balls have been pocketed, the moving billiard game when a shooting team player pockets the marked ball while at least two of the cue ball, the marked ball and any remaining object ball(s) are in motion.

4. The method of claim 3, wherein winning the moving billiard game further comprises requiring the shooting team player to call a pocket before pocketing the marked ball.

5. The method of claim 3, further comprising losing the moving billiards game when the marked ball is pocketed on the break or is pocketed before all of the team balls of the shooting team player are pocketed.

6. The method of claim 3, wherein determining a team player to break the rack of object balls with the cue ball comprises an election method comprising:

positioning a first team player at the head of the billiard table and a second team player near the foot of the billiard table;

positioning a first cue stick and the cue ball on the surface of the billiard table near the head of the table;

positioning a second cue stick and the marked ball on the surface of the billiard table near the foot of the table;

presenting a start indication to the first and second team players;

balancing, by the first and second team players, handle portions of the respective first and second cue sticks on the cue ball and the marked ball, respectively;

declaring one of the first team player and the second team player who first balances a cue stick for at least three seconds on one of the cue ball and the marked ball a break winner; and electing, by the break winner, to one of break the rack of object balls or allow an opposing team player to break the rack of object balls.

7. The method of claim 6, further comprising, subsequent to providing the start indication, limiting the first team player and the second team player to the use of one hand to balance the handle end of the cue stick on one of the cue ball and the marked ball.

8. The method of claim 3, wherein the long side wall and the short side wall are sized to provide a stylized double-bolt arrangement of greater than eleven object balls comprising a marked ball at an apex position followed by more than five rows that includes two object balls in each row forming a zig-zag configuration.

9. The method of claim 3, wherein the long side wall and the short side wall are sized to provide a stylized double-bolt arrangement of less than eleven object balls comprising a marked ball at an apex position followed by less than five rows that includes two object balls in each row forming a zig-zag configuration.

10. The method of claim 3, wherein the front long wall and the front short wall form an apex therebetween with an interior angle of approximately sixty degrees but are sized to permit rows that include more than two object balls in each row forming a zig-zag configuration.

* * * * *